US012279709B2

(12) United States Patent
Gu

(10) Patent No.: US 12,279,709 B2
(45) Date of Patent: Apr. 22, 2025

(54) CUP HOLDER MOUNT FOR EXERCISE MACHINE

(71) Applicant: Haidong Gu, Pomona, CA (US)

(72) Inventor: Haidong Gu, Pomona, CA (US)

(73) Assignee: CYCLINGDEAL USA, INC., CA (US)

( * ) Notice: Subject to any disclaimer, the term of this patent is extended or adjusted under 35 U.S.C. 154(b) by 134 days.

(21) Appl. No.: 18/107,519

(22) Filed: Feb. 9, 2023

(65) Prior Publication Data

US 2023/0180953 A1 Jun. 15, 2023

Related U.S. Application Data

(63) Continuation-in-part of application No. 17/388,017, filed on Jul. 29, 2021, now abandoned.

(51) Int. Cl.
*A47G 23/02* (2006.01)

(52) U.S. Cl.
CPC .... *A47G 23/0225* (2013.01); *A63B 2225/682* (2013.01)

(58) Field of Classification Search
CPC ..... A47G 23/0208; A47G 23/0216; A47G 23/0225; A63B 2225/68; A63B 2225/682; A63B 2225/685; A63B 2225/687
USPC ..... 224/420; D7/620
See application file for complete search history.

(56) References Cited

U.S. PATENT DOCUMENTS

| | | | | |
|---|---|---|---|---|
| 4,614,452 | A * | 9/1986 | Wang | F16C 11/10 403/97 |
| 6,505,802 | B2 * | 1/2003 | Fowler | B60N 3/103 248/230.5 |
| 9,315,321 | B2 * | 4/2016 | Browne | H01F 7/0263 |
| 9,402,016 | B1 * | 7/2016 | Hidalgo | H04N 23/51 |
| 9,729,185 | B2 * | 8/2017 | Scully | H04M 1/04 |
| 9,963,183 | B2 * | 5/2018 | Karl | B62J 45/10 |
| 10,309,584 | B2 * | 6/2019 | Johnson | F16B 2/065 |
| 10,588,812 | B2 * | 3/2020 | Brockway | A61H 3/00 |
| 11,160,405 | B2 * | 11/2021 | Jones | A61G 5/10 |
| 11,299,227 | B1 * | 4/2022 | Fang | B62J 9/20 |
| 11,364,964 | B2 * | 6/2022 | Summers | B62J 11/00 |
| 11,569,860 | B2 * | 1/2023 | Gu | A47B 23/06 |
| 11,866,111 | B2 * | 1/2024 | Drew | B62J 11/00 |
| 11,878,758 | B2 * | 1/2024 | Wen | B62J 11/04 |
| 11,882,950 | B2 * | 1/2024 | Bowen | A47G 23/0216 |
| 2013/0248569 | A1 * | 9/2013 | Hsu | B62J 45/10 224/440 |
| 2019/0009850 | A1 * | 1/2019 | Peters | B62J 50/225 |
| 2023/0030769 | A1 * | 2/2023 | Gu | A47G 23/0225 |
| 2023/0031003 | A1 * | 2/2023 | Gu | F16M 11/105 |
| 2023/0109955 | A1 * | 4/2023 | Gu | F16B 2/10 455/575.1 |
| 2023/0180953 | A1 * | 6/2023 | Gu | A47G 23/0225 220/737 |

* cited by examiner

*Primary Examiner* — Jonathan Liu
*Assistant Examiner* — Guang H Guan

(57) ABSTRACT

A cup holder mount includes a cup holder having a tubular portion extending from an outside of the cup holder, and the tubular portion includes a pivot. A clamp unit is connected to a handle of an exercise machine and includes a connection section which includes a hole. The pivot is adjustably and pivotably inserted into the hole.

5 Claims, 9 Drawing Sheets

CUP HOLDER MOUNT FOR EXERCISE MACHINE

BACKGROUND OF THE INVENTION

1. Fields of the Invention

The present invention is a Continuation-In-Part patent application of applicant's former patent application with application Ser. No. 17/388,017, filed on Jul. 29, 2021.

2. Descriptions of Related Art

When using an exercise machine, a large amount of water will inevitably be lost during exercise. Therefore, it is important to supplement water appropriately during exercise. Nevertheless, the use of exercise bikes, for example, belongs to aerobic exercise, and usually requires continuous more than 20 minutes working to gain an obvious effect. That is to say, the user operates the exercise bike continuously for more than 20 minutes before getting off the bike, which is quite inconvenient for replenishing water.

The present invention intends to provide a cup holder mount that is easily connected to the handle of an exercise machine, and the cup or the like is conveniently positioned and accessed so as to eliminate shortcomings mentioned above.

SUMMARY OF THE INVENTION

The present invention relates to a cup holder mount and comprises a cup holder having a tubular portion extending from outside of the cup holder. The tubular portion includes a pivot located therein. A clamp unit is connected to a handle of an exercise machine and includes a connection section which includes a hole. Multiple first magnets are located at an inside of the pivot, and multiple second magnets are located at an inside of the hole of the connection section. The first and second magnets are magnetically attracted with each other. The pivot is adjustably and pivotably inserted into the hole. A cup or the like is positioned in the cup holder.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
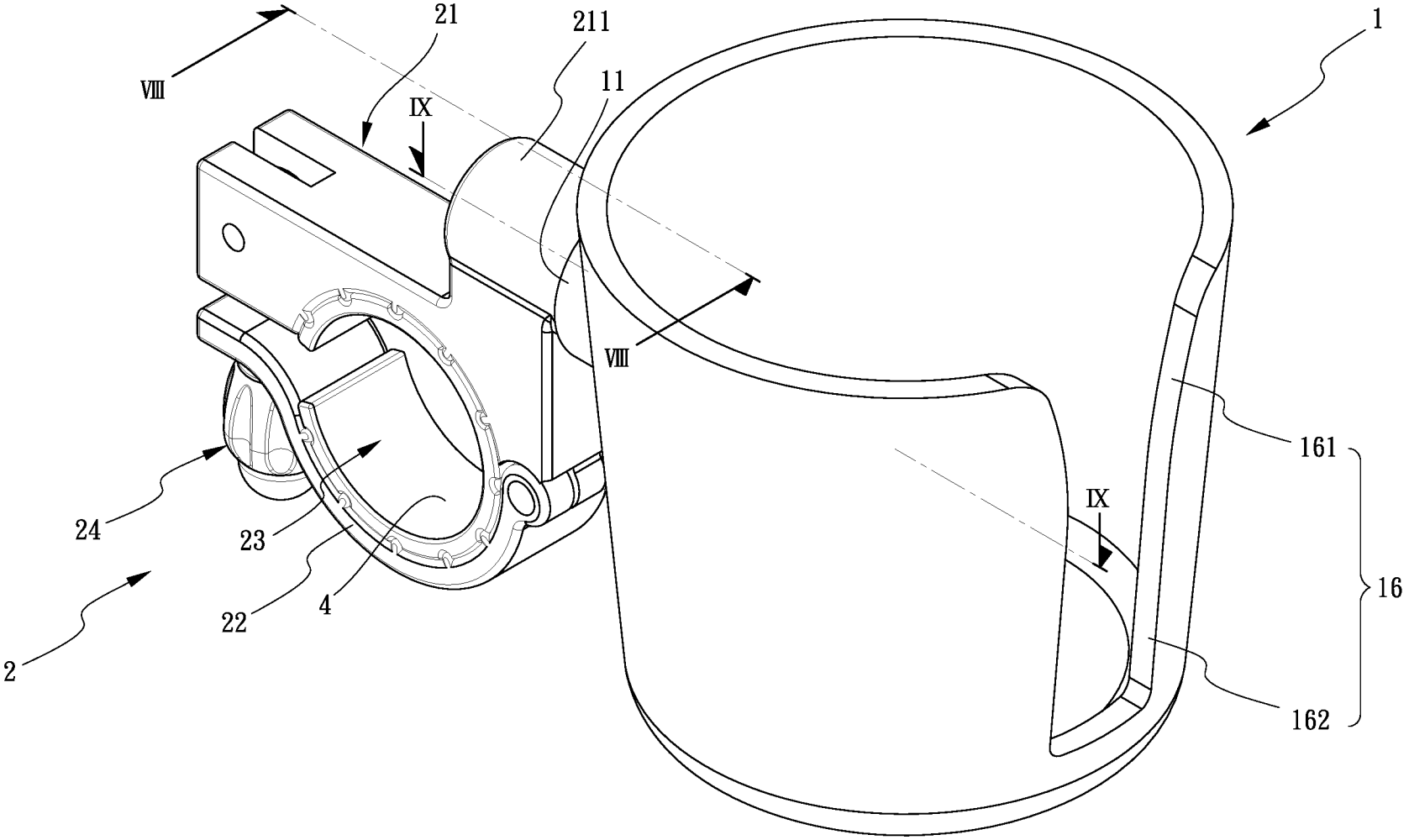
FIG. 1 is a perspective view to show the cup holder mount of the present invention.

Referring to FIGS. 1 to 7, the cup holder mount of the present invention comprises a cup holder 1 having a tubular portion 11 extending from outside of the cup holder 1. The tubular portion 11 includes a pivot 12 located centrally and axially in the interior room of the tubular portion 11. A clamp unit 2 includes a connection section 211 which includes a hole 212, and the pivot 12 is pivotably inserted into the hole 212.

Figure 3:
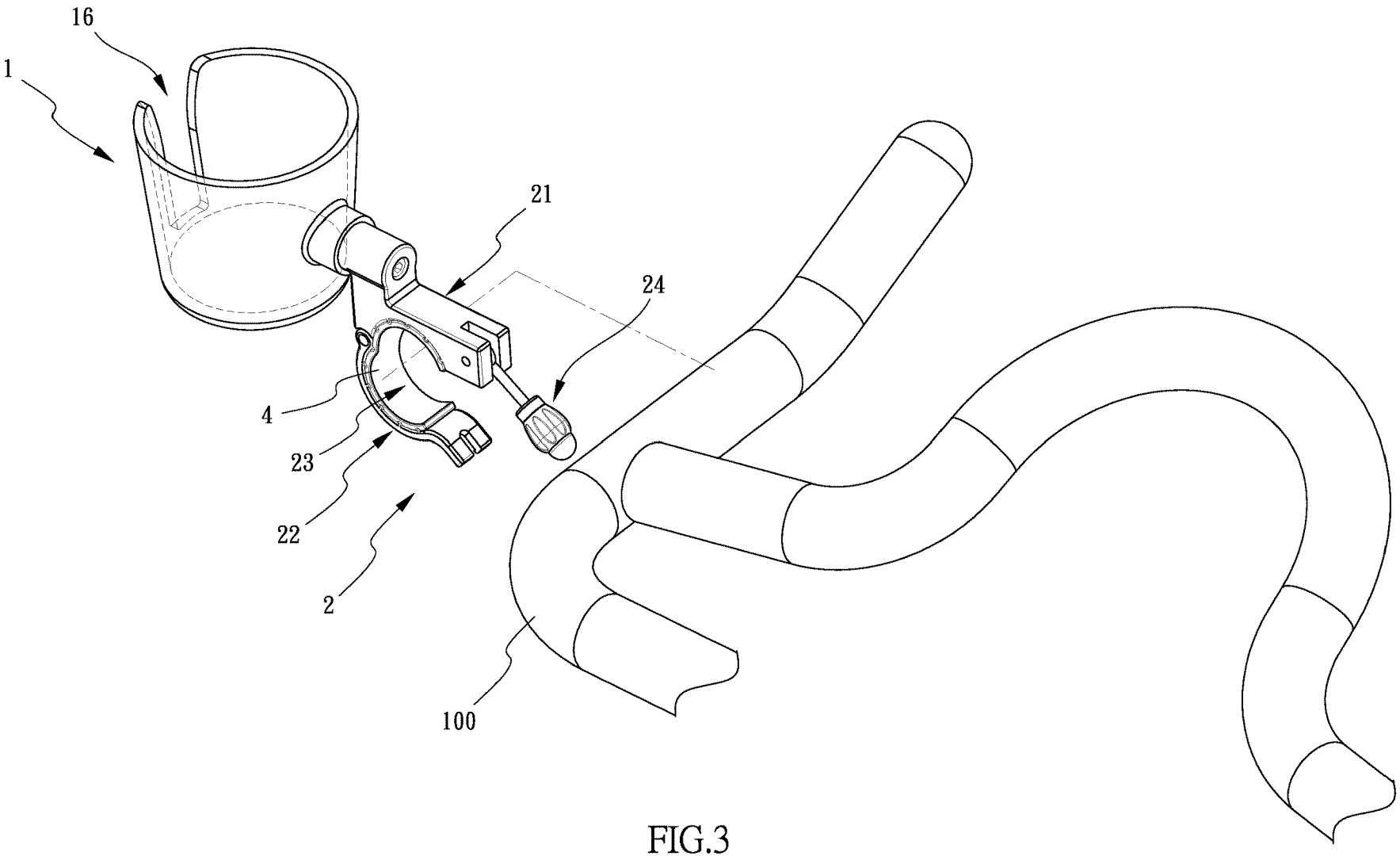
FIG. 3 shows that the clamp unit of the cup holder mount of the present invention is to be connected to the handle of the exercise machine.
Figure 4:
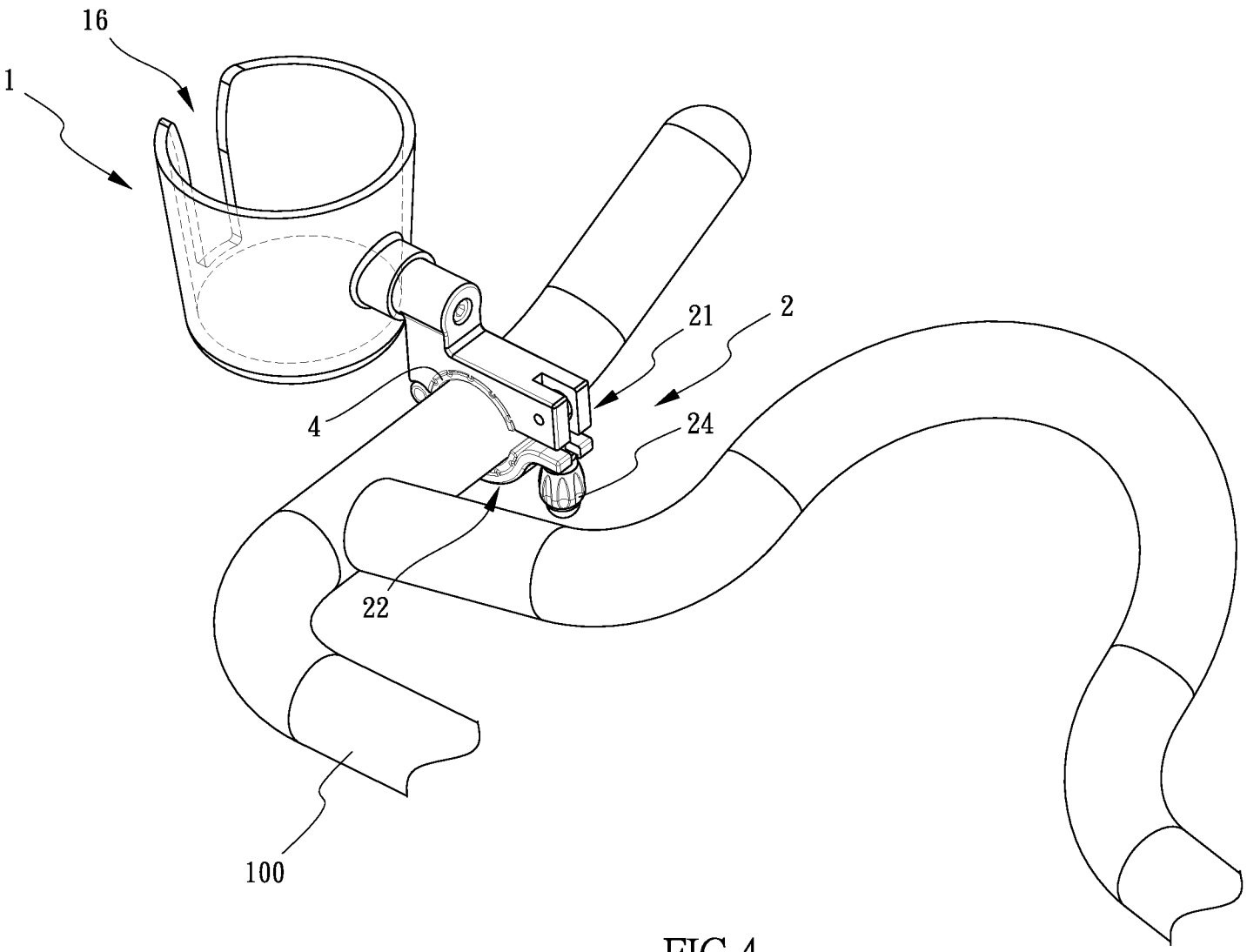
FIG. 4 shows that the clamp unit of the cup holder mount of the present invention is connected to the handle of the exercise machine.
Figure 5:
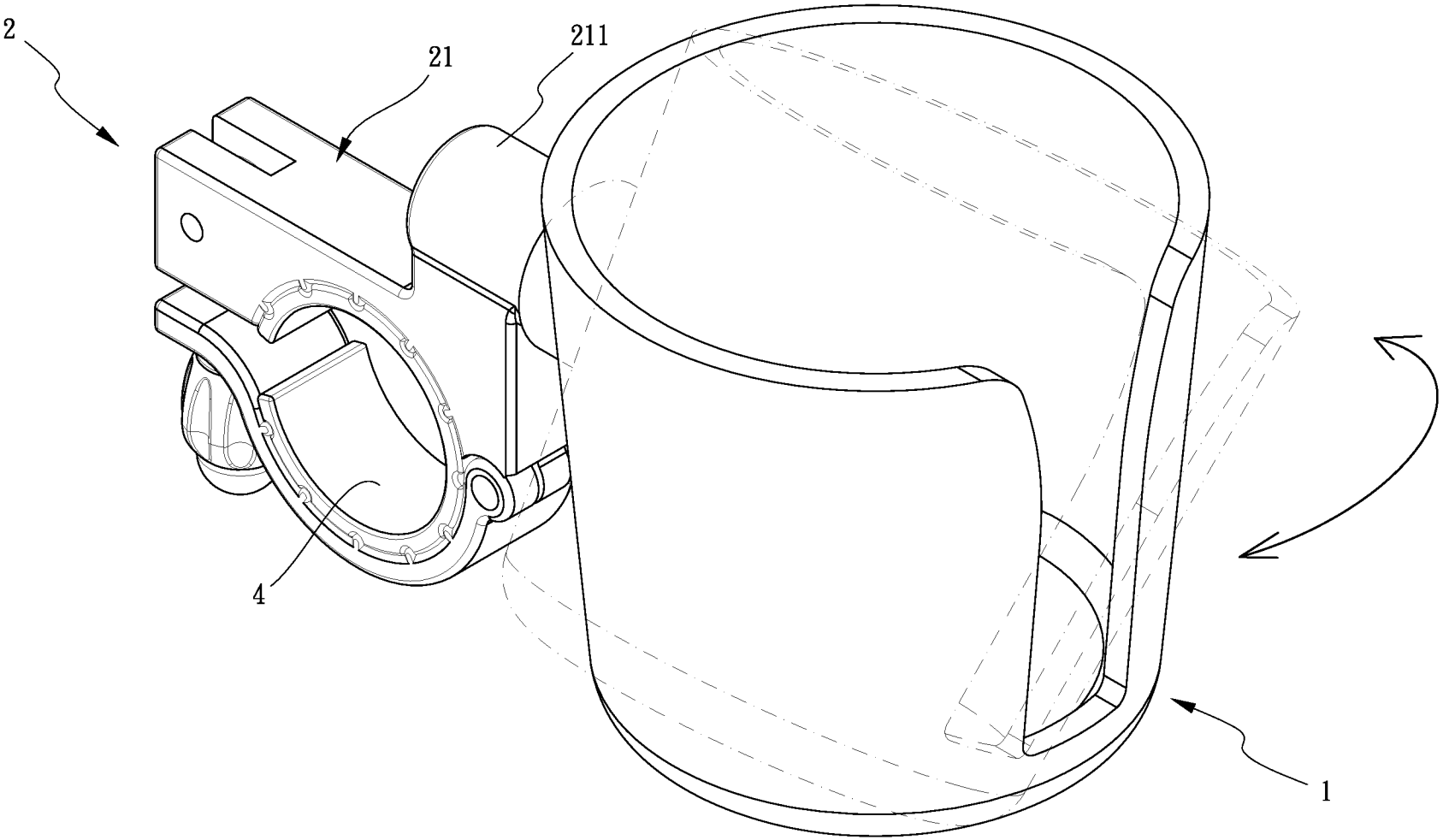
FIG. 5 shows that the cup holder is pivoted relative to the handle of the exercise machine.
Figure 6:
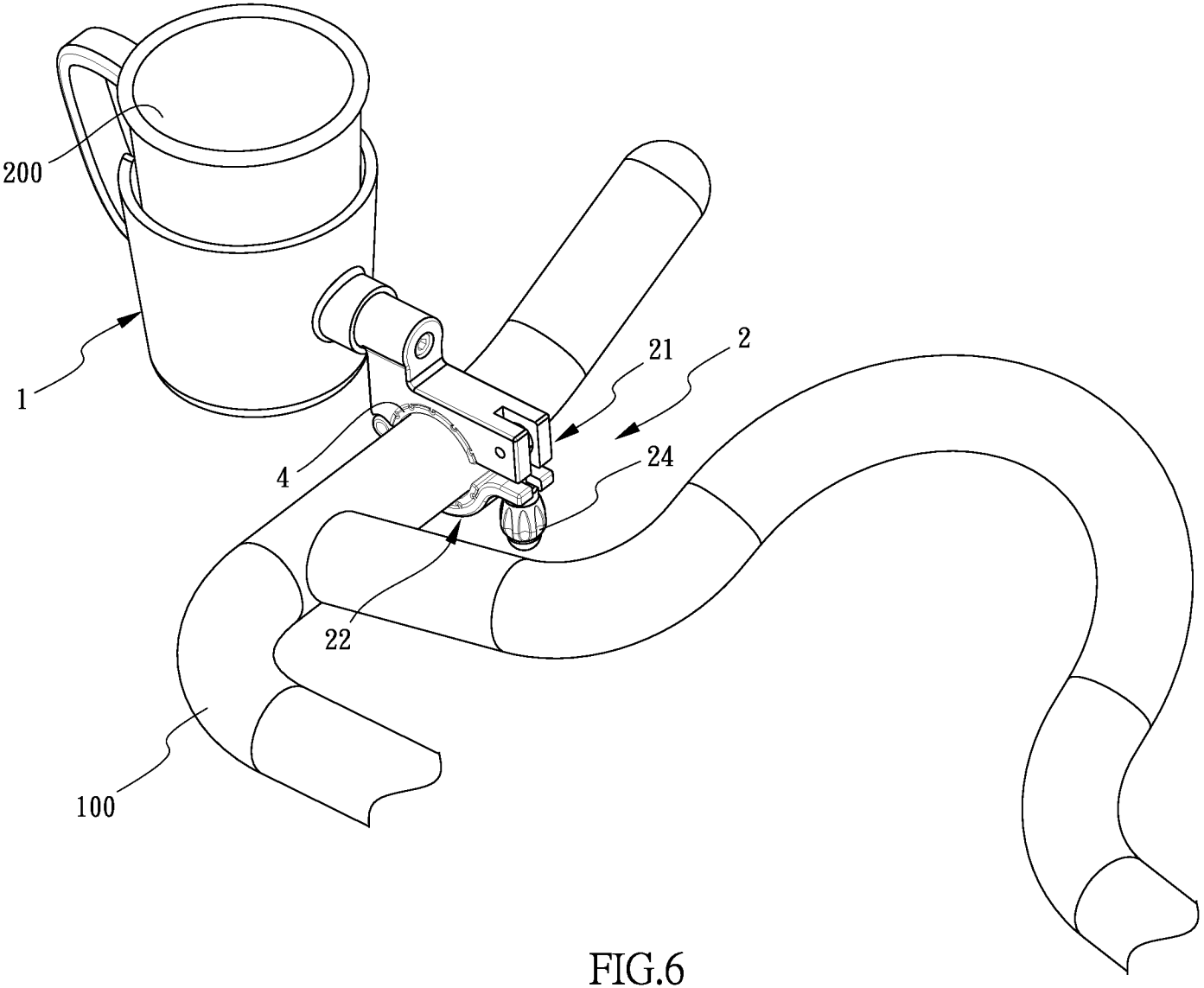
FIG. 6 shows that a cup is put in the cup holder of the present invention.
Figure 7:
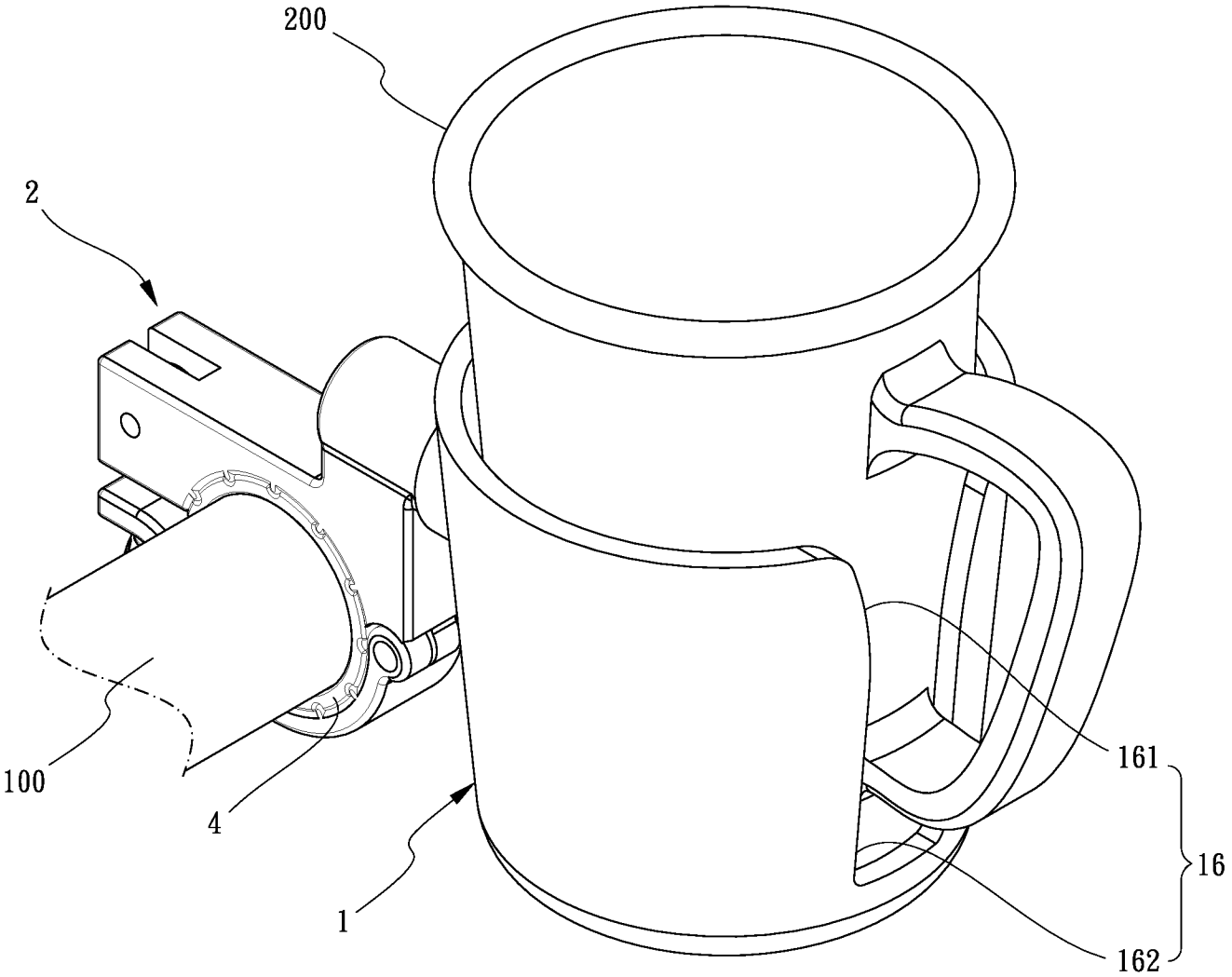
FIG. 7 is another angle of view to show a cup put in the cup holder of the present invention.

As shown in FIGS. 3 and 4, the clamp unit 2 is connected to the handle 100 of an exercise machine as shown in FIG. 4, and the cup holder 1 is pivotable relative to the clamp unit 2 so that a cup 200 is easily put in the cup holder 1 and accessed as shown in FIGS. 6 and 7.

The clamp unit 2 includes a first part 21 and a second part 22. The first part 21 includes the connection section 211 and a fixed portion 215. The fixed portion 215 includes a first end 216 and a second end 217, wherein the second part 22 has a first end pivotably connected to the first end 216 of the fixed portion 215, and a second end of the second part 22 is connected to the second end 217 of the fixed portion 215 by a locking member 24. A space 23 is formed between the second part 22 and the fixed portion 215, and the handle 100 is clamped in the space 23. The locking member 24 can be a quick-release device.

As shown in FIGS. 1 to 9, the connection section 211 includes first toothed face 213 located around the hole 212. An annular groove 14 is formed between an inner periphery of the tubular portion 11 and the pivot 12. A second toothed face 15 is formed on the inner bottom of the annular groove 14 and located around the pivot 12. The connection section 211 is inserted into the annular groove 14, and the first toothed face 213 is engaged with the second toothed face 15. Therefore, the cup holder 1 is secured and does pivot about the connection section 211. The angle that the cup holder 1 relative to the clamp unit 2 can be adjusted by the engagement between the first toothed face 213 and the second toothed face 15.

The first toothed face 213 of the connection section 211 is located opposite to the second end 217 of the first part 21, such that when the second part 22 is pivoted away from the first part 21, the cup holder 1 does not interfere the operation of the second part 22.

The cup holder 1 includes an opening 16 that extends from the lower portion of the wall that extends from the bottom of the cup holder 1 toward the top open end of the cup holder 1. The opening 16 is an elongate opening and includes an outward section 161 and a straight section 162. The outward section 161 communicates with the top open end of the cup holder 1. The width of the opening 16 is increased from the bottom of the cup holder 1 toward the top open end of the cup holder 1. When using the cup 200 with a handle 100, the handle 100 of the cup 200 is located in the opening 16 so that the cup 200 does not shift and is easily positioned. The outward section 161 of the opening makes the cup 200 easily be put in the cup holder 1 as well.

Figure 8:
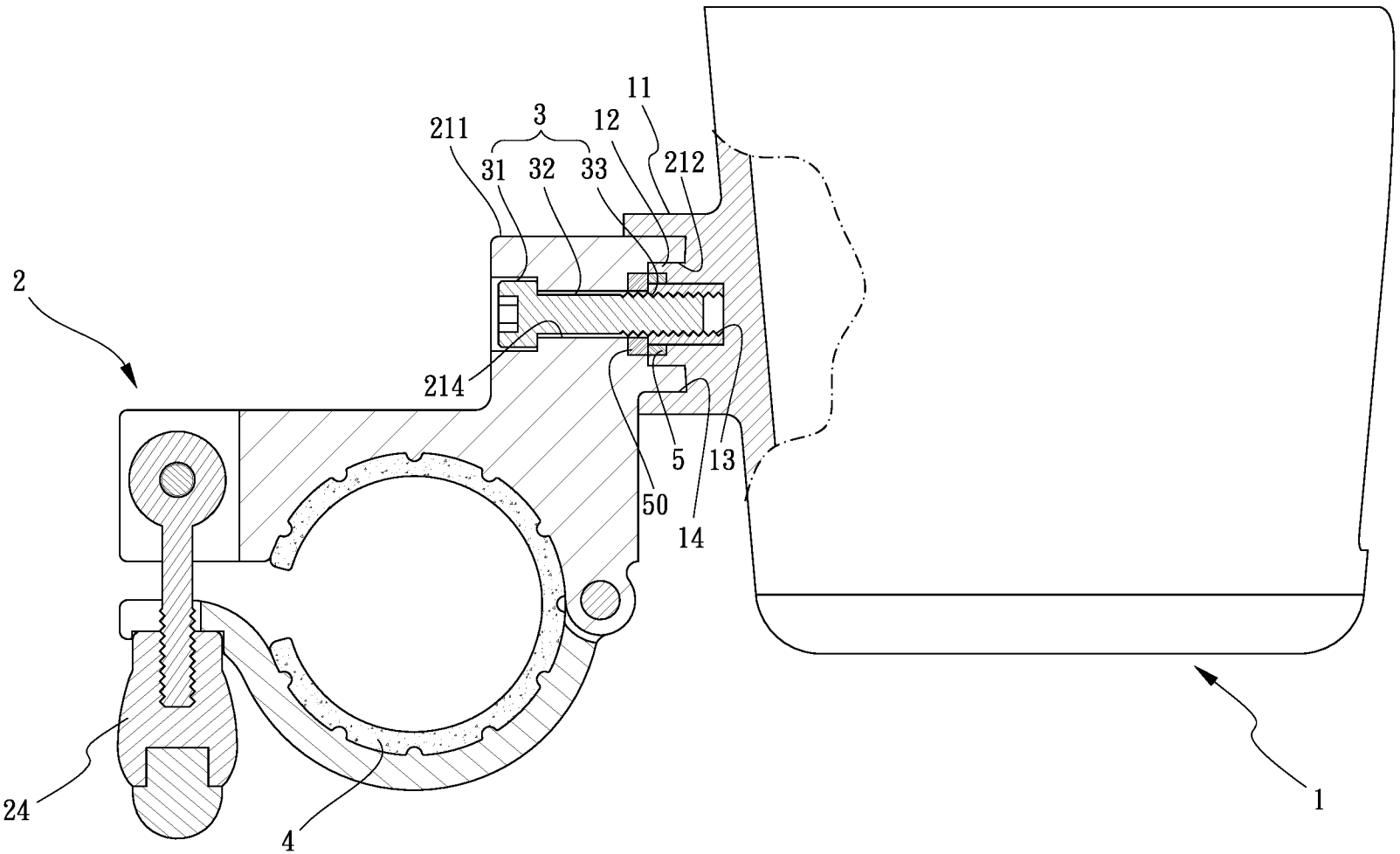
FIG. 8 is a cross sectional view, taken along line VIII-VIII in FIG. 1.
Figure 9:
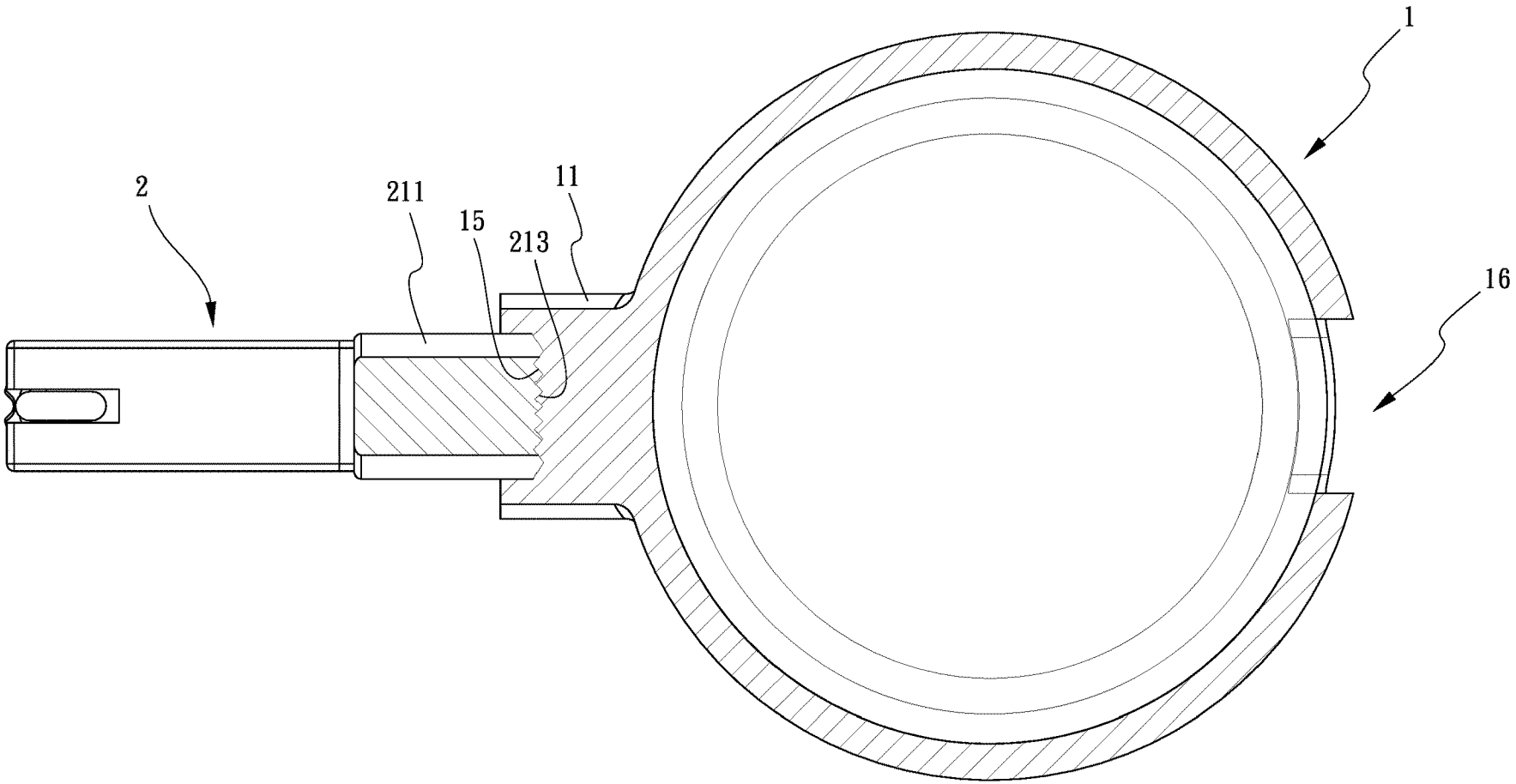
FIG. 9 is a cross sectional view, taken along line IX-IX in FIG. 1.

As shown in FIG. 8, the connection section 211 includes a passage 214 which communicates with the hole 212. The pivot 12 of the cup holder 1 includes a threaded hole 13. A bolt 3 includes a head 31, a smooth section 32 and a threaded section 33, wherein the smooth section 32 is formed between the head 31 and the threaded section 33. The bolt 3 extends through the passage 214 and is threadedly connected to the threaded hole 13. The smooth section 32 is located in the passage 214, and the threaded section 33 is engaged with the threaded hole 13. The head 31 contacts the connection section 211 to securely connect the cup holder 1 to the clamp unit 2. The smooth section 32 is located in the passage 214 so that when rotating the bolt 3, the cup holder 1 does not rotate.

A flexible plate 4 is connected to an inner face of two respective inner faces of the second part 22 and an inner face of the fixed portion 215, and the flexible plate 4 faces the space 23. As shown in FIG. 8, multiple ridges extending radially and inward from the inner face of the second part 22 and the inner face of the fixed portion 215 of the first part 21. The flexible plate 4 includes multiple notches defined in an outer periphery thereof. The ridges are engaged with the notches so that the flexible plate 4 is not shifted relative to the fixed portion 215 of the first part 21 and the second part 22. That is to say, the flexible plate 4 provides anti-slip feature, and also ensures that the clamp unit 2 is securely mounted to the handle 100.

Figure 2:
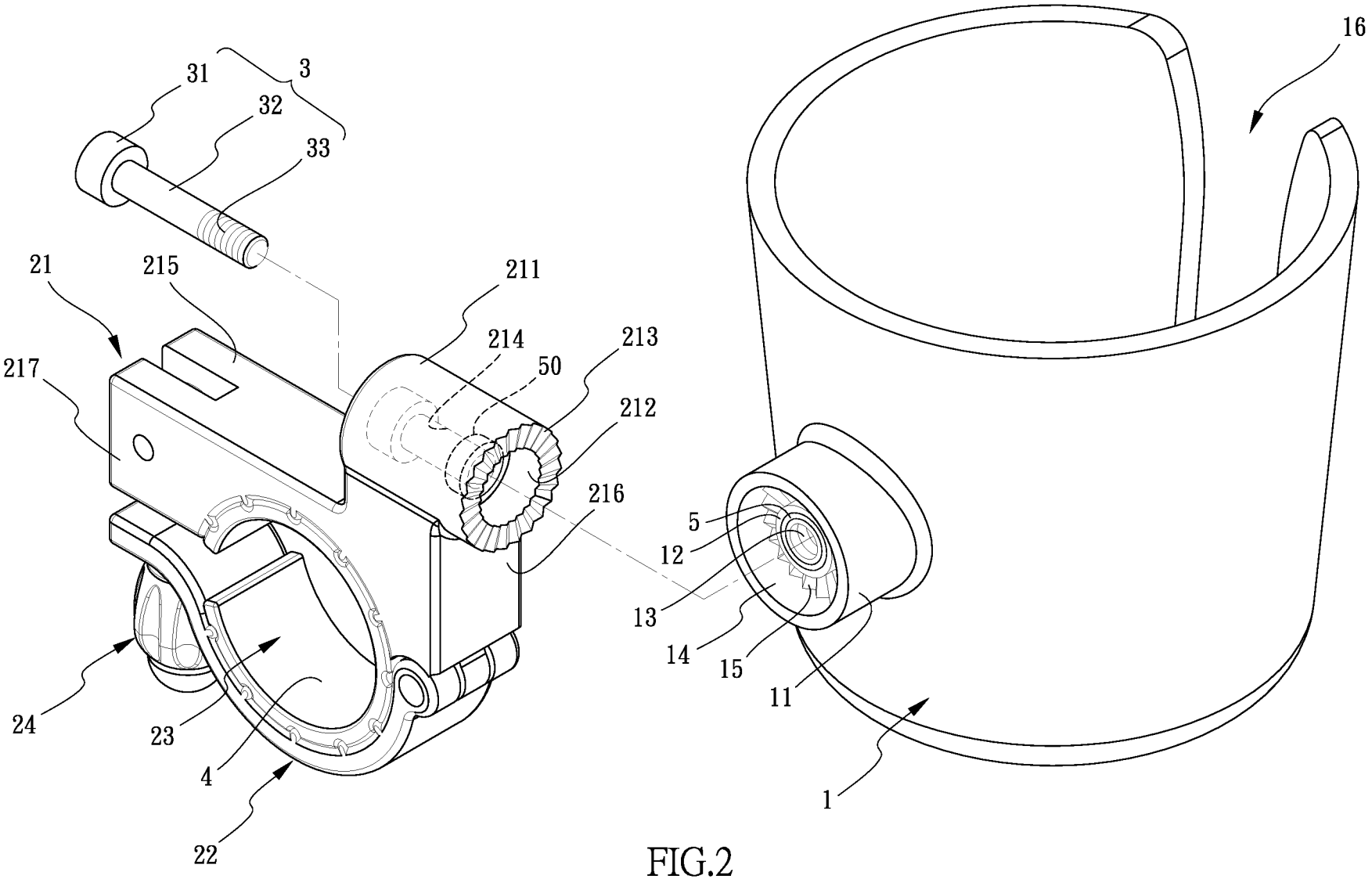
FIG. 2 is an exploded view of the cup holder mount of the present invention.

As shown in FIGS. 2 and 8, the present invention further comprises multiple first magnets 5 located at an inside of the pivot 12, and multiple second magnets 50 located at an inside of the hole 212 of the connection section 211. The first and second magnets 5, 50 magnetically attracted with each other when the connection section 211 is inserted into the tubular portion 11. The advantages of the first and second magnets 5, 50 of the present invention are that when adjusting the angular position of the cup holder 1 by unscrewing the bolt 3, the cup holder 1 is maintained to be connected to the connection section 211 by the magnetic connection between the first and second magnets 5, 50. Besides, the first and second magnets 5, 50 do not affect rotation between the tubular portion 11 and the connection section 211. It is noted that the cup holder 1 has a certain weight. If there is no the first and second magnets 5, 50 to hold the cup holder 1, the cup holder 1 may drop when the bolt 3 is unscrewed. Accordingly, the first and second magnets 5, 50 play an important role to hold the cup holder 1 during adjustment.

While we have shown and described the embodiment in accordance with the present invention, it should be clear to those skilled in the art that further embodiments may be made without departing from the scope of the present invention.

What is claimed is:

1. A cup holder mount comprising:

a cup holder having a tubular portion extending from an outside of the cup holder, the tubular portion including a pivot, wherein the pivot includes a threaded hole, and an annular groove is formed between an inner periphery of the tubular portion and the pivot;

a clamp unit including a first part and a second part, the first part including a fixed portion and a connection section which includes a hole, and the pivot being pivotably inserted into the hole of the connection section, wherein the fixed portion includes a first end and a second end, the second part has a first end pivotably connected to the first end of the fixed portion, a second end of the second part is connected to the second end of the fixed portion by a locking member, a space is formed between the second part and the fixed portion, the connection section includes a passage which communicates with the hole of the connection section, the connection section is inserted into the annular groove, the connection section includes a first toothed face located around the hole of the connection section and engaged with a second toothed face, and the second toothed face is formed on an inner bottom of the annular groove and located around the pivot;

a bolt including a head, a smooth section and a threaded section, wherein the smooth section is formed between the head and the threaded section, the bolt extends through the passage and is threadedly connected to the threaded hole, the smooth section is located in the passage, the threaded section is engaged with the threaded hole, and the head contacts the connection section; and a first magnet located at an inside of the pivot, a second magnet located at an inside of the hole of the connection section, the first and second magnets magnetically attracted to each other.

2. The cup holder mount as claimed in claim 1, wherein the first toothed face of the connection section is located opposite to the second end of the first part.

3. The cup holder mount as claimed in claim 1, wherein the cup holder includes an opening that extends from a bottom of the cup holder toward a top open end of the cup holder.

4. The cup holder mount as claimed in claim 3, wherein the opening is an elongate opening including an outward section and a straight section, the outward section communicates with the top open end of the cup holder, and a width of the elongate opening is increased from the bottom of the cup holder toward the top open end of the cup holder.

5. The cup holder mount as claimed in claim 1, wherein a flexible plate is connected to an inner face of the second part and an inner face of the fixed portion, and the flexible plate faces the space.

* * * * *